United States Patent [19]

Page, Jr.

[11] 3,977,473

[45] Aug. 31, 1976

[54] WELL TUBING ANCHOR WITH AUTOMATIC DELAY AND METHOD OF INSTALLATION IN A WELL

[76] Inventor: John S. Page, Jr., 10424 Echo River Court, Fountain Valley, Calif. 92708

[22] Filed: July 14, 1975

[21] Appl. No.: 595,561

[52] U.S. Cl. ..... 166/315; 166/207; 166/212; 166/217

[51] Int. Cl.[2] ..... E21B 23/04; E21B 43/10

[58] Field of Search ..... 166/212, 206, 207, 217, 166/315

[56] References Cited

UNITED STATES PATENTS

| | | | |
|---|---|---|---|
| 2,350,973 | 6/1944 | Brumleu et al. | 166/212 X |
| 2,735,497 | 2/1956 | Brumleu et al. | 166/212 |
| 3,002,564 | 10/1961 | Baker | 166/212 |
| 3,011,557 | 12/1961 | Conrad | 166/212 |
| 3,180,419 | 4/1965 | Cochran et al. | 166/120 |
| 3,454,092 | 7/1969 | Page, Jr. | 166/212 |
| 3,528,500 | 9/1970 | Brown | 166/212 |

*Primary Examiner*—Stephen J. Novosad
*Attorney, Agent, or Firm*—William W. Haefliger

[57] ABSTRACT

A well tubing anchor incorporates means to delay movement of slips relative to a wedge surface until predetermined well fluid pressure is exerted on a piston or pistons that urge the slips axially.

14 Claims, 4 Drawing Figures

WELL TUBING ANCHOR WITH AUTOMATIC DELAY AND METHOD OF INSTALLATION IN A WELL

BACKGROUND OF THE INVENTION

This invention relates generally to well tubing anchors, and more particularly concerns an anchor and its method of use which overcome many problems characteristic of known anchors.

Two types of tubing anchors are commonly in use today. One has a slip-cone wedging engagement with well casing that provides the stability in the casing. This type requires tubing rotation to set it and accurate well data to make calculations so that the correct amount of tension can be pulled into the tubing. In order to land the tubing in tension, a special threaded tensioning device is required at the top of the tubing. Also, to release the anchor, the tubing must be rotated to the right. Experience shows that such anchors are sometimes very difficult to loosen from the casing.

The other type of anchor is an hydraulic tool utilizing a piston that pushes a shoe radially outwardly against the casing. While this type anchor sets automatically without any tubing manipulation, it does not provide the stability in the casing that the slip-cone type anchor provides. For example, it often undergoes a slight movement that causes the seal or packer to fail in heavy pumping wells. Also, this type anchor sets prior to tubing elongation that tends to buckle the tubing above the anchor.

SUMMARY OF THE INVENTION

It is a major object of the present invention to provide an anchor that incorporates the advantages of the above referenced prior anchors while eliminating disadvantages of each. Basically, the invention is embodied in an anchor that comprises:

a. a tubular body connectible in series with a well tubing string, there being a wedge surface on the body and tapering axially, b. slip means and a carrier therefore movable axially relative to the body so that the slip means is urged relatively radially outwardly toward the casing by the wedge surface, c. piston means carried for axial movement relative to the body, the piston means operatively connected with said carrier and having piston surface extent exposed to well fluid pressure acting to urge the piston means, carrier and slips axially as aforesaid, and d. delay means to transmit force acting to delay said relative movement of the carrier and slip means until predetermined well fluid pressure is exerted on said piston surface extent.

As will be seen, the delay means typically comprises spring means such as one or more tension springs extending within the anchor body in compact relation to the slip carrier in the form of a sleeve, and also in compact relation to multiple pistons connected with the carrier. The number of such springs used, and/or the tension exerted by each spring, can be pre-selected to pre-determine the force resisting displacement of the piston means so that such displacement can be delayed until the well pressure exerted on the pistons reaches a chosen level. This prevents gripping of the casing by the anchor prior to the time that the tubing has been substantially stretched by fluid weight transmitted to the tubing during pumping, so that such gripping takes place only after pre-determined stretch of the tubing. This avoids or minimizes the problem of buckling of the tubing above the anchor where the anchor is set prior to tubing elongation, and the tubing subsequently elongates. Also, setting of the anchor is automatic and stable, and does not require tubing manipulation.

These and other objects and advantages of the invention, as well as the details of an illustrative embodiment, will be more fully understood from the following description and drawings, in which:

DRAWING DESCRIPTION

DETAILED DESCRIPTION

Figure 1:
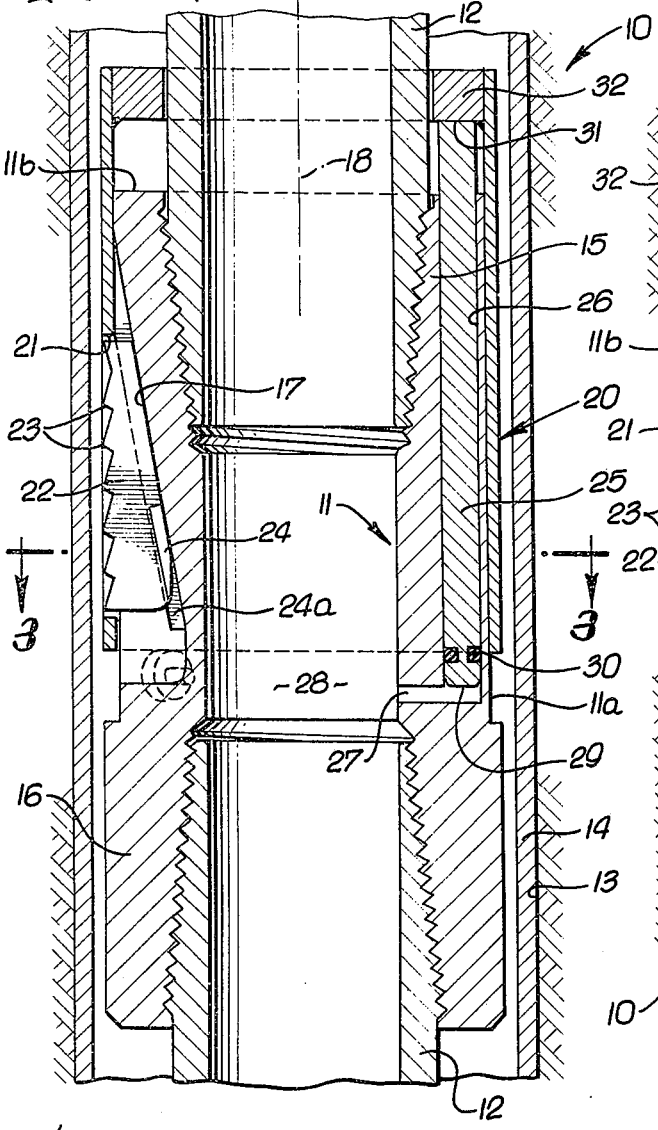
FIG. 1 is an elevation taken in section through a tubing anchor embodying the invention.
Figure 2:
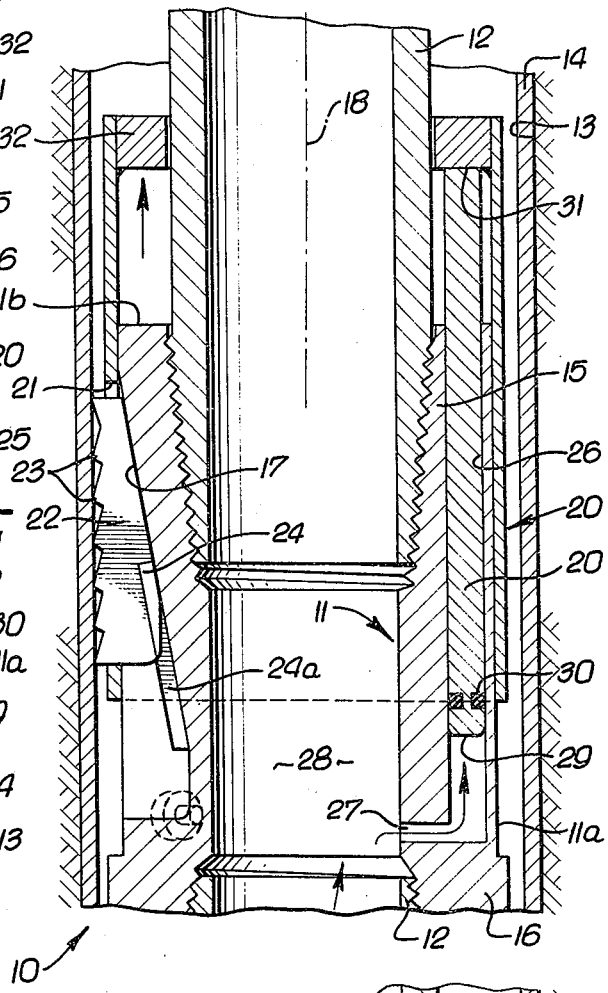
FIG. 2 is a view like FIG. 1, but showing the anchor in actuated condition.

The tool 10 shown in the drawings includes a tubular body 11 connected in series with tubing 12 in a string. The latter is located in a well 13 cased at 14. The body 11 includes threaded box members 15 and 16 at its opposite ends into which threaded pin members at the ends of the tubing are connected. At least on, and preferably three wedge surfaces 17 are provided on the body to taper axially. In the illustrated embodiment, the wedge surface or surfaces define a cone tapering downwardly, the body being oriented upright and having a vertical axis 18 which is coincident with the cone axis.

The apparatus also includes slip means and a carrier therefor movable axially relative to the body, so that the slip means is urged relatively radially outwardly toward the casing by the wedge or cone surface during slip means relative axial movement. In the illustrated example, the carrier comprises a sleeve 20 extending about and slidable axially lengthwise on the tubular body outer surface 11*a*. The tubular sleeve defines three side windows 21 spaced about axis 18 to receive three slips 22 having jaws or serrations 23 facing downwardly to engage the casing bore. The slips are formed to have T-shaped horizontal cross sections to define bosses or ears 24 fitting in T-shaped slots 24*a* milled in the body 11, whereby the slips are loosely retained to the body as they are moved up and down with and by the sleeve, and along tapered wedge or cone surfaces 17.

The apparatus incorporates piston means carried for axial movement relative to the tubular body 11, such piston means being operatively connected with the carrier or sleeve 20 and having piston surface extent exposed to well fluid pressure acting to urge the piston means, carrier and slips axially to set the slips. In the illustrated embodiment, the piston means includes multiple piston 25 which are axially elongated and spaced at equal angles about the body axis within axial bores 26 in the body. Ports 27 communicate between a vertical through passage 28 in the body and the piston surface extent, i.e. piston surfaces 29 at the lower ends of the pistons, whereby well fluid pressure on the tubing tends to elevate the pistons in the body. Annular seals 30 on the pistons seals off between the pistons and the bores 26. The upper ends of the pistons are connected at 31 to an annulus 32 extending directly above the upper end 11*b* of the body and integral with carrier sleeve 20, so that the carrier and slips are elevated as the pistons move up.

Figure 3:
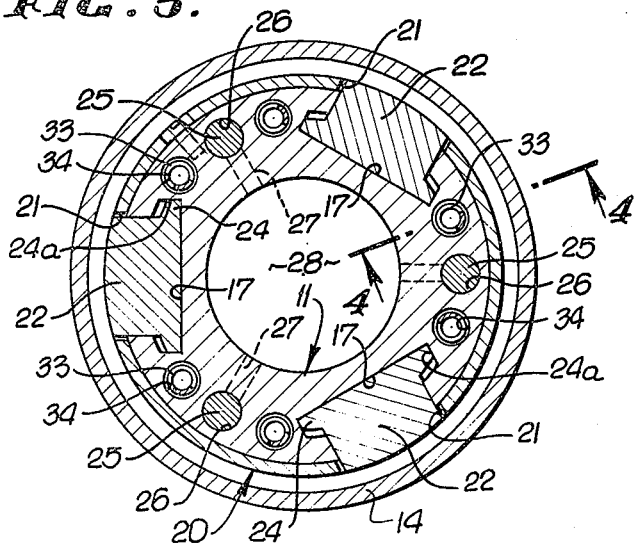
FIG. 3 is a horizontal section taken on lines 3—3 of FIG. 1.

In accordance with an important feature of the invention, delay means is provided to transmit force acting to delay axial movement of the carrier and slips by the pistons and relative to the body until predetermined well fluid pressure is exerted on the piston surface or surfaces 29. Typically, such delay means may comprise spring means carried by the body, as for example at least one and preferably multiple tension springs 33 extending axially within body axial openings 34 spaced circularly relative to the piston bores 26. Note that one bore 26 and two spring openings 34 are shown in FIG. 3 in the space between successive slips, whereby the assembly is very compact in design, enabling foreshortening of body axial length. The number of springs employed or used in the openings 34 is selected to match, approximately, the delay force to be achieved and resisting upward displacement of the pistons by fluid pressure, whereby the fluid pressure required to set to slips can be pre-selected in a very simple and efficient manner.

Figure 4:
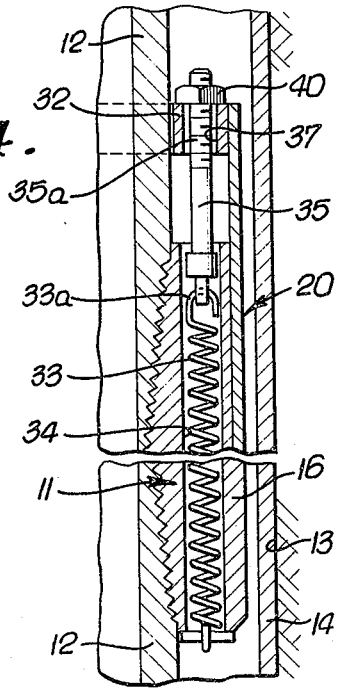
FIG. 4 is a vertical section on lines 4-4 of FIG. 3.

Also, the tension of the springs employed can be carried as by the adjusting means shown in FIG. 4. As illustrated, the upper ends 33*a* of the springs are attached to axial fasteners 35, and the latter may be moved up or down relative to the ring 32 as by rotation of a nut 40 on the threaded upper end 35*a* of each fastener projecting upwardly through an opening 37 in the ring 32. This may of course be done prior to running of the anchor and tubing in the well.

In operation, the springs 33 urge the sleeve 20 downwardly, the sleeve in turn urging the slips downward to FIG. 1 position prior to setting of the anchor. The slips are urged radially inwardly by the walls of the downwardly tapered slots 24*a* in the body. After a delay interval corresponding to well pressure rise to predetermined level, the upward force communicated to the pistons overcomes the downward spring force, and the pistons displace the sleeve 20 upwardly, the slips thereby being displaced upwardly and cammend outwardly by wedge surfaces 17 to engage and anchor to the casing. This anchors the tubing to the casing, without requiring any surfaces manipulation of the tubing. Further, the anchor may be forcibly pulled or dragged out of the well with sufficient upward force applied to the tubing, without requiring prior tubing rotation.

Due to the angularity and downward inclination of the teeth 23, any attempted elongation of the tubing, after initial setting of the anchor, will act to further drive the teeth into the casing, to finally set the anchor.

I claim:

1. In apparatus to anchor well tubing to well casing, a. a tubular body having an axis and an outer side wall, the body connectible in series with a well tubing string, there being a wedge surface on the body and tapering axially, b. slip means and a carrier therefore movable axially relative to the body so that the slip means is urged relatively radially outwardly toward the casing by the wedge surface, c. piston means carried for axial movement relative to the body, the piston means operatively connected with said carrier and having piston surface extent exposed to well fluid pressure acting to urge the piston means, carrier and slips axially as aforesaid, and d. delay means to transmit force acting to delay said relative movement of the carrier and slip means until predetermined well fluid pressure is exerted on said piston surface extent, said delay means comprising spring means carried by the body, said spring means including at least one spring and said piston means including at least one piston, said spring located in its entirety at one side of said axis and said piston located in its entirety at one side of said axis, said spring and piston confined within a cylinder defined by the body outer side wall.

2. The apparatus of claim 1 wherein said carrier comprises a sleeve extending about the tubular body and having windows, said slip means including multiple slips located in said windows.

3. The apparatus of claim 1 wherein the body axis is upright, the wedge surface defines a cone tapering downwardly, and the slip means, carrier and piston means are movable upwardly relative to the body to effect radial outward movement of the slips.

4. The apparatus of claim 1 including said tubing string, said body connected in series with the string.

5. In apparatus to anchor well tubing to well casing, a. a tubular body connectible in series with a well tubing string, there being a wedge surface on the body and tapering axially, b. slip means and a carrier therefore movable axially relative to the body so that the slip means is urged relatively radially outwardly toward the casing by the wedge surface, c. piston means carried for axial movement relative to the body, the piston means operatively connected with said carrier and having piston surface extent exposed to well fluid pressure acting to urge the piston means, carrier and slips axially as aforesaid, and d. delay means to transmit force acting to delay said relative movement of the carrier and slip means until predetermined well fluid pressure is exerted on said piston surface extent, said delay means comprising spring means carried by the body, said spring means including at least one tension spring extending axially and located within the body, and said piston means including at least one piston extending axially and located within the body.

6. The apparatus of claim 5 including spring tension adjusting means carried by the body and connected with said spring.

7. The apparatus of claim 5 wherein said body contains axially extending openings receiving said spring means and piston means, at least one opening exposed to the interior of said tubular body for communicating well pressure to said piston means.

8. In apparatus to anchor well tubing to well casing, a. a tubular body connectible in series with a well tubing string, there being a wedge surface on the body and tapering axially, b. slip means and a carrier therefore movable axially relative to the body so that the slip means is urged relatively radially outwardly toward the casing by the wedge surface, said carrier comprising a sleeve extending about the tubular body and having windows, said slip means including multiple slips located in said windows, c. piston means carried for axial movement relative to the body, the piston means operatively connected with said carrier and having piston surface extent exposed to well fluid pressure acting to urge the piston means, carrier and slips axially as aforesaid, and d. delay means to transmit force acting to delay said relative movement of the carrier and slip means until predetermined well fluid pressure is exerted on said piston surface extent, said delay means comprising spring means carried by the body, said spring means including multiple tension springs extending axially and located within the body inwardly of said sleeve, said springs operatively connected between said body and said sleeve.

9. The apparatus of claim 8 wherein said piston means includes multiple pistons extending axially within the body, the pistons spaced about the body axis and the springs also spaced about the body axis at loci between the pistons.

10. The apparatus as defined in claim 9 wherein the body forms a through passage, and also forms porting communicating between said passage and said piston surface extent.

11. The apparatus of claim 8 including spring tension adjustment fasteners connected between the springs and the sleeve.

12. The apparatus of claim 8 wherein said body includes an internal box thread to receive a tubing pin member, said box thread located radially inwardly of said sleeve and tension springs.

13. The method of installing anchor apparatus in a well, the apparatus comprising:

a. a tubular body connectible in series with a well tubing string, there being a wedge surface on the body and tapering axially, b. slip means and a carrier therefore movable axially relative to the body so that the slip means is urged relatively radially outwardly toward the casing by the wedge surface, c. piston means carried for axial movement relative to the body, the piston means operatively connected with said carrier and having piston surface extent exposed to well fluid pressure acting to urge the piston means, carrier and slips axially as aforesaid, and d. delay means to transmit force acting to delay said relative movement of the carrier and slip means until predetermined well fluid pressure is exerted on said piston surface extent, the delay means comprising spring means, said method comprising e. adjusting said spring means to provide predetermined force acting on said piston means to delay said axial movement thereof, f. running said achor apparatus into a well in series with said well tubing and exposing the piston means to well fluid pressure.

14. The method of claim 13 wherein said adjusting step is carried out by connecting a selected number of tension springs with said carrier.

* * * * *